US006766847B1

(12) United States Patent
Wang

(10) Patent No.: US 6,766,847 B1
(45) Date of Patent: Jul. 27, 2004

(54) AUTO-REVERSIBLE FOLDING SLIDING DOOR

(76) Inventor: Wen-Tsan Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 10/409,184

(22) Filed: Apr. 9, 2003

(51) Int. Cl.[7] ..... E06B 3/94

(52) U.S. Cl. ..... 160/199; 160/84.06; 160/190

(58) Field of Search ..... 160/199, 84.04, 160/84.06, 206, 190, 193

(56) References Cited

U.S. PATENT DOCUMENTS 4,953,611 A * 9/1990 Verstraten ..... 160/199
5,377,737 A * 1/1995 Moriya et al. ..... 160/84.06
5,456,303 A * 10/1995 Horinouchi ..... 160/84.04
5,477,904 A * 12/1995 Yang ..... 160/370.23
5,937,929 A * 8/1999 Chen ..... 160/370.23

* cited by examiner

*Primary Examiner*—David Purol
(74) *Attorney, Agent, or Firm*—Leong C. Lei

(57) ABSTRACT

An auto-reversible folding sliding door is constructed to include a horizontal top track, a vertical post fixedly provided at one end of the track, a hollow cylindrical casing movable, a folding collapsible door panel coupled to the track and movable along the track between an extended position and a received position, the folding collapsible door panel having a fixed end fastened to the post and a free end fixedly fastened to the casing, a plurality of cord members transversely fastened to the hinged vertical slats of the folding collapsible door panel at different elevations to guide the folding collapsible door panel between the extended position and the received position, the cord members each having a first end fixed to one vertical side of the folding collapsible door panel adjacent to the post and a second end inserted through each vertical slat into the inside of the casing and extended over a pulley inside the casing and then fixedly connected to a weight.

3 Claims, 5 Drawing Sheets

AUTO-REVERSIBLE FOLDING SLIDING DOOR

BACKGROUND OF THE INVENTION

1. Field of the Invention

The present invention relates to folding collapsible sliding doors and, more particularly, to an auto-reversible folding sliding door.

2. Description of the Related Art

A pleated curtain, screen, folding collapsible sliding door, etc., may be used in a house as an ornamental partition to divide a room into two separated spaces for different purposes. These devices can also be used to regulate light or air. However, the user must employ much effort to open/close a pleated curtain, screen or folding collapsible sliding door.

SUMMARY OF THE INVENTION

The present invention has been accomplished under the circumstances in view. It is one object of the present invention to provide an auto-reversible folding sliding door, which enables the user to close/open the folding collapsible door panel with less effort. It is another object of the present invention to provide an auto-reversible folding sliding door, which keeps the folding collapsible door panel in the open status when unlocked. According to one aspect of the present invention, the auto-reversible folding sliding door comprises a horizontal top track, a vertical post fixedly provided at one end of the track, a hollow cylindrical casing movable, a folding collapsible door panel coupled to the track and movable along the track between an extended position and a received position, the folding collapsible door panel having a fixed end fastened to the post and a free end fixedly fastened to the casing, a plurality of cord members transversely fastened to the folding collapsible door panel at different elevations to guide the folding collapsible door panel between the extended position and the received position, the cord members each having a first end fixed to one vertical side of the folding collapsible door panel adjacent to the post and a second end inserted through the body of the folding collapsible door panel into the inside of the casing and extended over a pulley inside the casing and then fixedly connected to a weight. According to another aspect of the present invention, the folding collapsible door panel is comprised of a plurality of vertical slats that are hinged to one another. The vertical slats may be formed of fabrics.

DETAILED DESCRIPTION OF THE PREFERRED EMBODIMENT

Figure 1:
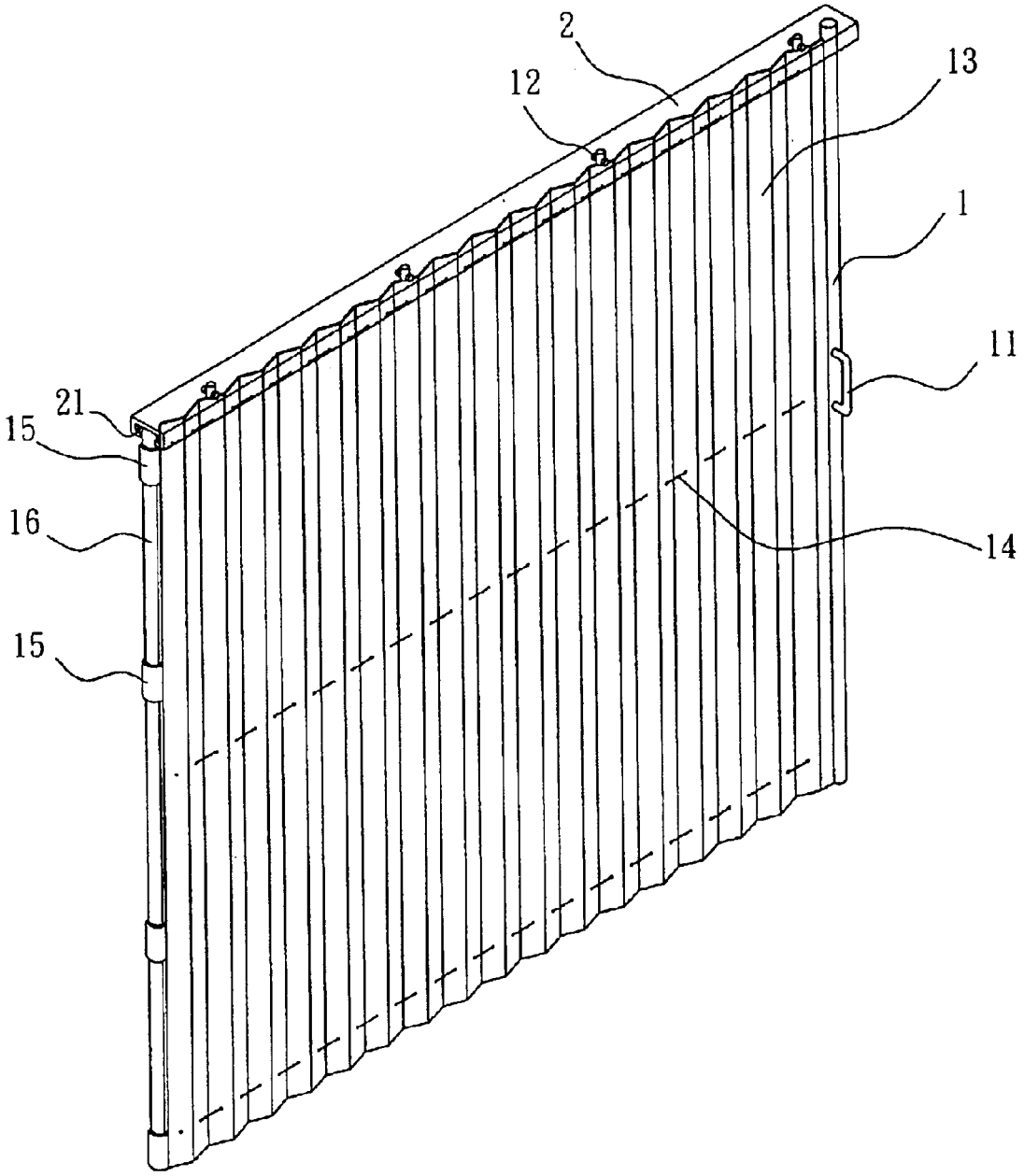
FIG. 1 is a perspective view of an auto-reversible folding sliding door constructed according to the present invention, showing the folding collapsible door panel extended out.

Referring to FIGS. from 1 through 5, an auto-reversible folding sliding door in accordance with the present invention is shown comprised of a track 2, and a folding collapsible door panel 13. The track 2 has two horizontal bottom bearing walls 21 bilaterally extended along the length and spaced from each other by a gap. The folding collapsible door panel 13 comprises a plurality of vertical slats 131 that are hinged to one another, a hollow cylindrical casing 1 fixedly and vertically extended along one side of the first one of the slats 131, a post 16 fixedly and perpendicularly connected to one end of the track 2, a plurality of fastening members (for example, hook and loop materials) 15 provided at the last one of the slats 131 to secure the last one of the slats 131 to the fixed post 16, a guide pulley 17 horizontally pivotally mounted inside the hollow cylindrical casing 1 near the top (adjacent to the track 2), a weight 18 suspending inside the hollow cylindrical casing 1 below the guide pulley 17, a plurality of cord members 14 respectively horizontally fastened to the vertical slats 131 at different elevations to join the vertical slats 131, the cord members 14 each having one end fixedly fastened to the last one of the vertical slats 131 and the other end inserted through (a respective through hole of) each of the vertical slats 131 (through a through hole of the casing 1) into the inside of the casing 1 and then extended over the guide pulley 17 and finally connected to the weight 18, a plurality of roller assemblies 12 mounted inside the track 2 and movably supported on the horizontal bottom bearing walls 21, and a plurality of carriers 121 respectively pivoted to the roller assemblies 12 to carry the vertical slats 131. Further, a handle 11 is located on the periphery of the hollow cylindrical casing 1 for moving the folding collapsible sliding door 13 between the close (extended) position and the open (received) position.

Figure 2:
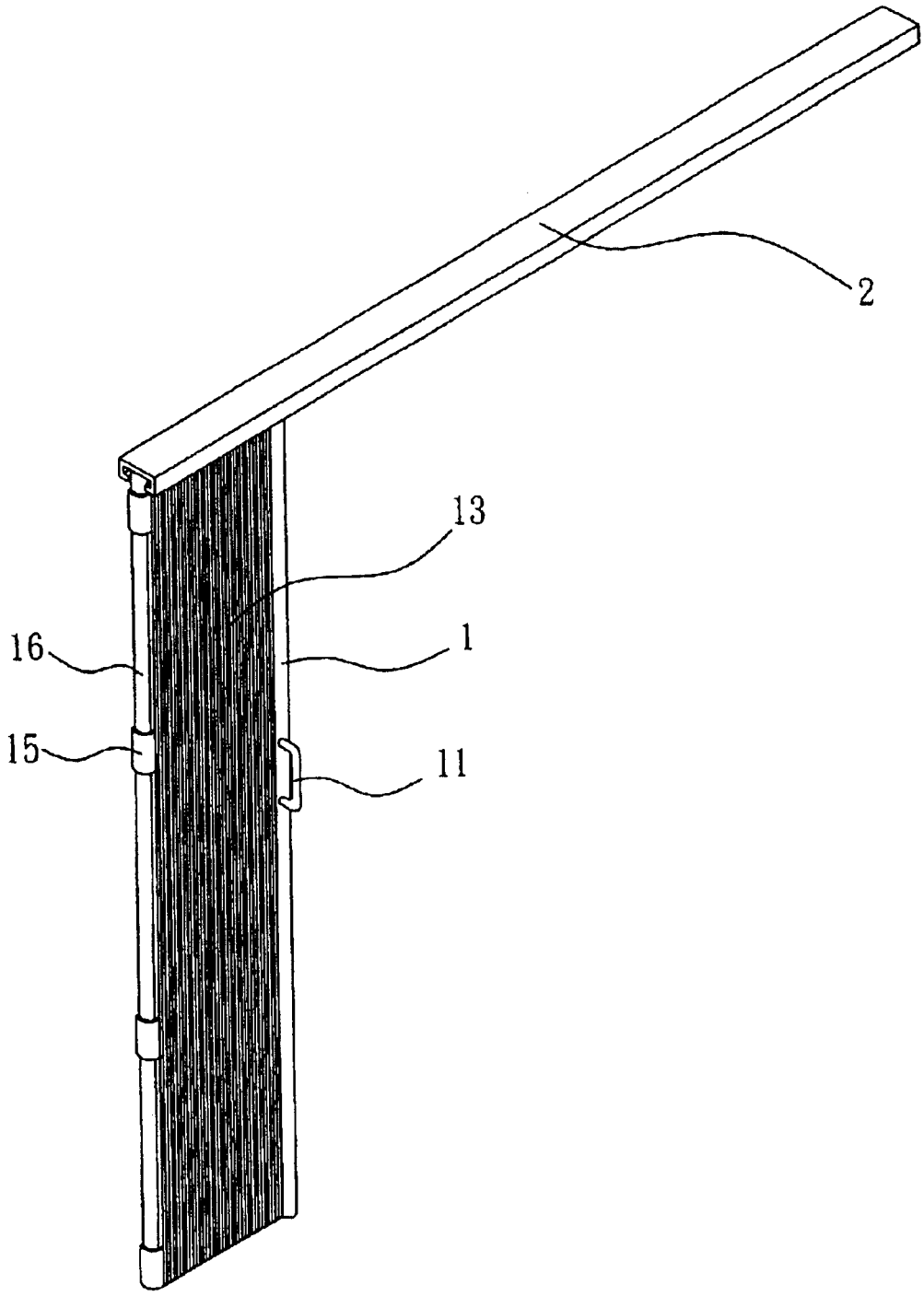
FIG. 2 is an elevational view of the present invention showing the folding collapsible door panel received.
Figure 3:
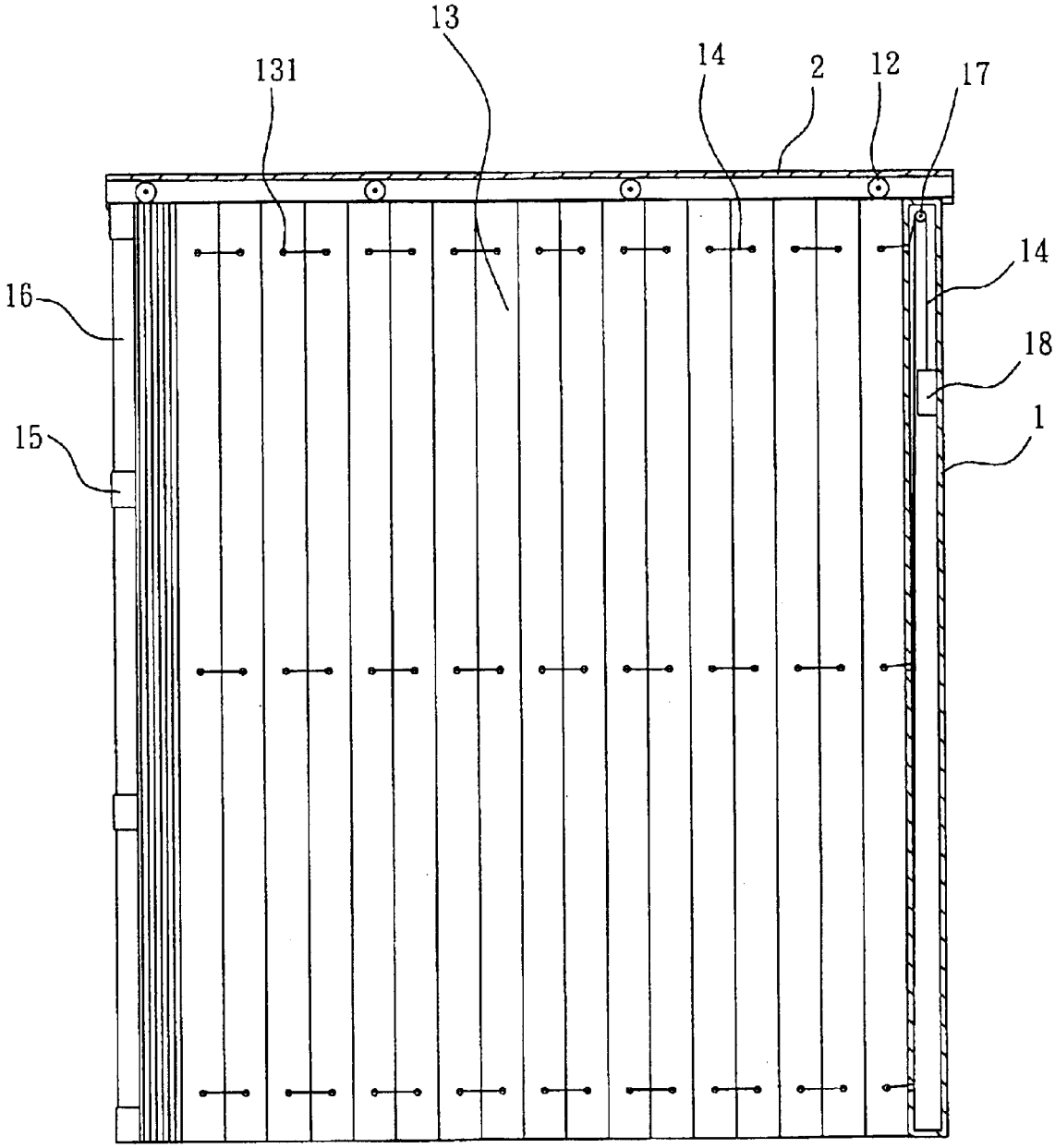
FIG. 3 is a front view in section of FIG. 1.
Figure 4:
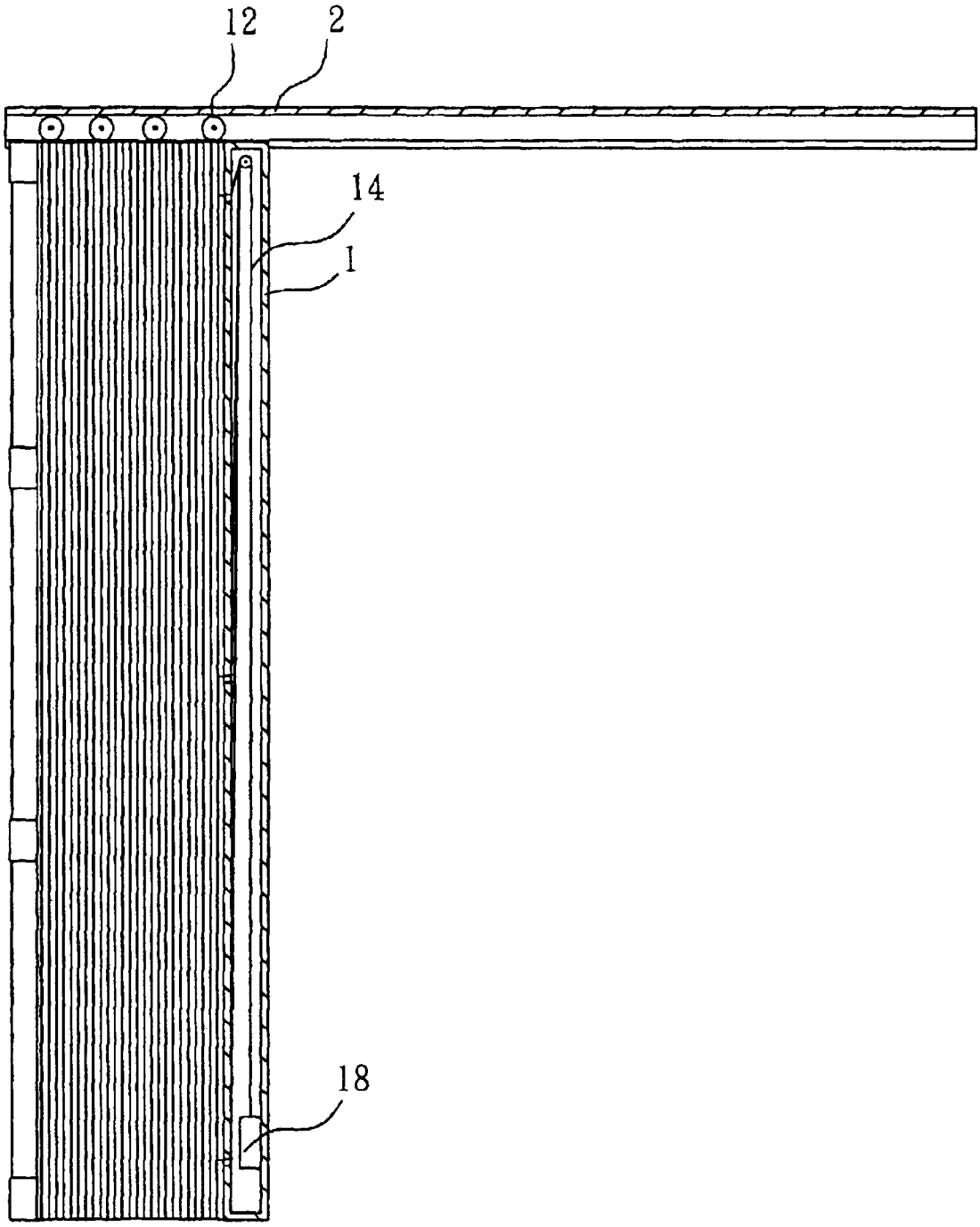
FIG. 4 is a front view in section of FIG. 2.
Figure 5:
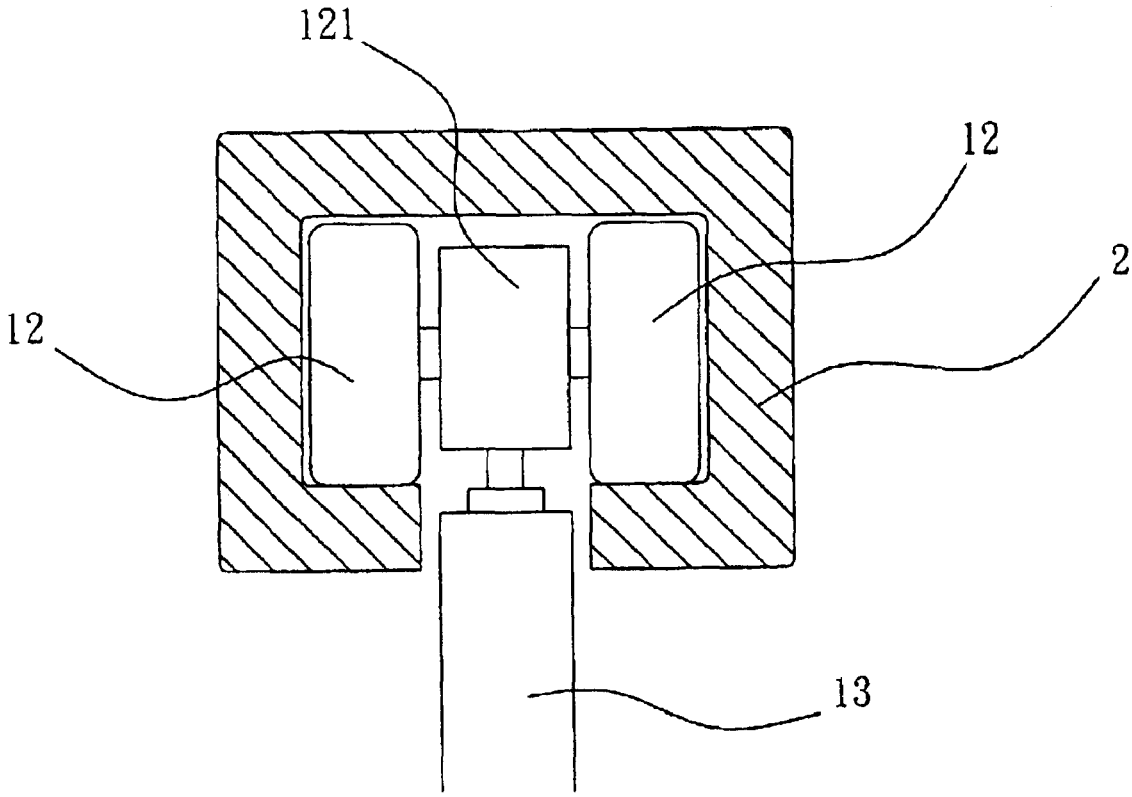
FIG. 5 is an enlarged view in section of a part of the present invention, showing the roller assembly supported on the horizontal bottom bearing walls of the track and the carrier pivoted to the roller assembly and coupled to the corresponding vertical slat.

Referring to FIGS. 1~5 again, the track 2 is fixedly fastened to the ceiling or a beam inside a house in a horizontal position, and then the post 16 is fixedly fastened to the wall of the house in vertical, and then the fastening members 15 of the folding collapsible door panel 13 are fastened to the post 16. When the user pulled the handle 11 to move the hollow cylindrical casing 1 along the track 2 in direction away from the post 16, the vertical slats 131 are extended out (see FIGS. 1 and 3). When the folding collapsible sliding door 13 fully extended out, the door lock (not shown) is fastened up to lock the folding collapsible sliding door 13 in the extended (close) position. At this time, the weight 18 is lifted to the upper position. When unlocked the door lock, the weight 18 falls due to the effect of its gravity weight, thereby causing the cord members 14 to pull the hollow cylindrical casing 1 along the track 2 to the post 16, and therefore the folding collapsible sliding door 13 is received, i.e., the door is opened (see FIGS. 2 and 4).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An auto-reversible folding sliding door comprising:

a track fixedly disposed in horizontal;

a post fixedly perpendicularly connected to one end of said track at a bottom side;

a hollow cylindrical casing vertically suspended below said track and movable along said track relative to said post;

a plurality of roller assemblies mounted inside said track and horizontally movable along said track;

a folding collapsible door panel, said folding collapsible door panel having a first vertical side fixedly fastened to said post and a second vertical side fixedly fastened to said hollow cylindrical casing;

a plurality of carriers respectively pivoted to said roller assemblies and coupled to said folding collapsible door panel for enabling said folding collapsible door panel to be moved with said hollow cylindrical casing relative to said post between an extended position and a received position;

a guide pulley pivotally mounted inside said hollow cylindrical casing near said track;

a weight suspending inside said hollow cylindrical casing below said guide pulley; and a plurality of cord members horizontally fastened to said folding collapsible door panel at different elevations to guide said folding collapsible door panel between said extended position and said received position, said cord members each having a first end fixedly fastened to the first vertical side of said folding collapsible door panel and a second end alternatively inserted through front and rear sides of folding collapsible door panel and extended out of the second vertical side of said folding collapsible door panel into the inside of said hollow cylindrical casing and then extended over said guide pulley and finally connected to said weight.

2. The auto-reversible folding sliding door as claimed in claim 1 wherein said folding collapsible sliding door is comprised of a plurality of vertical slats hinged to one another.

3. The auto-reversible folding sliding door as claimed in claim 1 wherein said hollow cylindrical casing has a handle located on the periphery thereof.

* * * * *